US007346949B2

(12) United States Patent
Kamrin-Balfour

(10) Patent No.: US 7,346,949 B2
(45) Date of Patent: Mar. 25, 2008

(54) INFANT SOOTHING AND SLEEP AID

(76) Inventor: Lori Kamrin-Balfour, 12345 Lk. City Way NE., #211, Seattle, WA (US) 98125

( * ) Notice: Subject to any disclaimer, the term of this patent is extended or adjusted under 35 U.S.C. 154(b) by 169 days.

(21) Appl. No.: 11/129,551

(22) Filed: May 13, 2005

(65) Prior Publication Data

US 2006/0010605 A1 Jan. 19, 2006

Related U.S. Application Data

(63) Continuation of application No. 10/886,815, filed on Jul. 8, 2004, now abandoned.

(51) Int. Cl.
*A47D 13/00* (2006.01)

(52) U.S. Cl. ..... 5/655; 5/904; 5/732

(58) Field of Classification Search ..... 5/417–420, 5/655, 940, 731, 732, 632, 633, 907, 630; 446/72; D6/598

See application file for complete search history.

(56) References Cited

U.S. PATENT DOCUMENTS

D290,917 S 7/1987 Rollins, Jr.
5,014,376 A 5/1991 Doran et al.
5,093,947 A 3/1992 Henegar et al.
5,357,642 A 10/1994 Clute
5,367,730 A * 11/1994 Sher ..... 5/655
5,784,733 A 7/1998 Rasamny et al.
5,865,771 A 2/1999 Shuto et al.
5,933,886 A 8/1999 Washington
6,054,926 A * 4/2000 Deleo ..... 340/573.1
6,097,294 A * 8/2000 Hilton ..... 340/573.1
6,473,923 B1 * 11/2002 Straub ..... 5/655

* cited by examiner

*Primary Examiner*—Michael Trettel
(74) *Attorney, Agent, or Firm*—Black Lowe & Graham, PLLC

(57) ABSTRACT

An infant soothing and sleep aid includes a fabric mat. A pair of removable and adjustable barriers are provided, one on either side, that act as a cradling mechanism to make the infant feel safe and secure in the large crib. The barriers include a soothing device such as a vibration mechanism and white noise mechanism in order to soothe the baby in the form of restricted movement, pleasing sounds, and motion.

16 Claims, 5 Drawing Sheets

INFANT SOOTHING AND SLEEP AID

PRIORITY CLAIM

This application is a continuation of application Ser. No. 10/886,815, filed Jul. 8, 2004, now abandoned.

FIELD OF THE INVENTION

The present invention relates generally to devices for making an infant feel safe and secure within a crib or bassinet, including devices for aiding the child to fall asleep.

BACKGROUND OF THE INVENTION

When infants are born, they have a fear of falling or being exposed. When in the womb, infants are snug and secure. When they are born they are free but uncomfortable in their roomy surroundings. They can be made to feel more secure by enclosing their surroundings. In a crib, for example, this can be accomplished by placing a blanket or other object on each side of them to keep them feeling snug and cradled at all times.

Infants also are afraid of unusual sounds on the one hand, and complete quiet on the other. While in the womb the baby is used to hearing many sounds that soothe them. When they are born they are often put into a silent room. This is discomforting for the infant and causes them concern that can make it impossible for them to fall asleep.

Another infant fear involves motion. Again, while in the womb a baby is in nearly constant movement, which is comforting to them. When they are born and the movement stops they are uneasy and therefore unable to fall asleep. There is a need, therefore, for a system that can address one or more of the foregoing concerns.

One solution for keeping the infant snug within the crib involves cradling the infant between two foam cushions, as shown in U.S. Pat. No. 5,341,531. A fabric mat includes locations for removably attaching a pair of foam cushions spaced apart from one another. When the infant is placed on the mat between the cushions, the device serves to secure the baby and restrict movement. Though the system may aid in limiting movement, it does not address the motion and sound issues confronted by infants. Therefore, there is a need for a device that incorporates the use of sound, vibration, and motion limitation in an infant friendly design to act as an infant soothing and sleep aide.

SUMMARY OF THE INVENTION

The preferred soothing and sleep aid in accordance with the present invention addresses the foregoing problems with the prior art. In one form, a fabric mat in the shape of a bear or other character is formed with two removable paws or arms, one on either side, that act as a cradling mechanism to make the infant feel safe and secure in the large crib. The paws include a vibration mechanism and white noise mechanism in order to soothe the baby by restricting movement and providing comforting sounds and motion, all in an aesthetically pleasing shape.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1A:
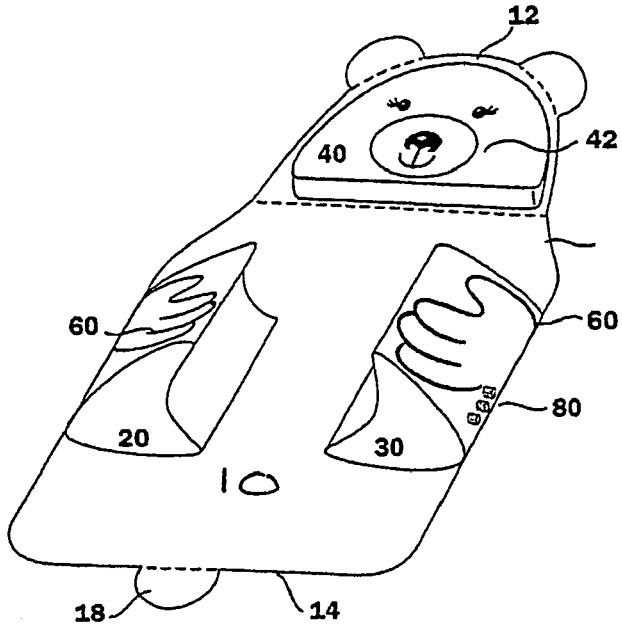
FIG. 1A is a perspective view of a preferred infant sleep aid.

FIG. 1A is a perspective view of a preferred infant sleep aid. As shown, the device includes a fabric mat 10 in the shape of a bear and two removably attached paws 20, 30. The mat includes a head end 12 and a tail end 14, with an outline of a bear face at the head end and a bear tail 18 defined at the tail end. Though a bear is the preferred shape, any number of other animal or other character shapes may be used for the mat. The head, tail, and paws (or arms, as desired) will also change accordingly.

A pillow 40 is removably attached to the head end of the mat. As an infant pillow, the pillow has a thin (preferably about one inch thick) foam pad removably enclosed within it. Stitched, printed, or otherwise provided on an outer surface of the pillow is the face 42 of a bear or other animal or character. An outline of the character face may also be provided at the head end of the mat, lying below the pillow. The pillow may be attached to the mat via hook and loop fasteners, snaps, zippers, or other means. Alternatively, pillow may remain fully separated from the mat or, conversely, sewn or otherwise permanently secured to the mat.

Figure 1B:
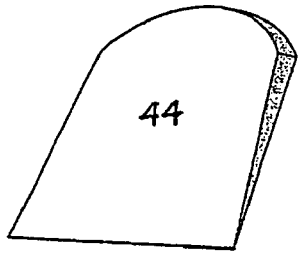
FIG. 1B is a perspective view of a preferred bolster.
Figure 1C:
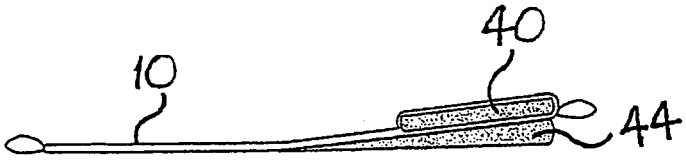
FIG. 1C is a side view of a preferred infant sleep aid.

An optional bolster 44 may also be included. As seen in FIG. 1B, the preferred bolster is wedge-shaped, and design to be placed under the mat to raise the head end of the mat in a gentle incline. A side view of the mat with the bolster 44 in place is shown in FIG. 1C.

Figure 2:
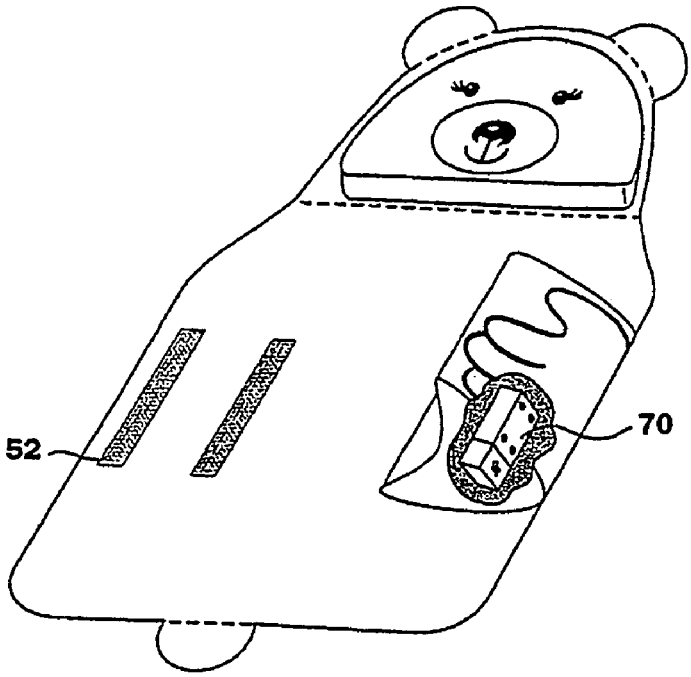
FIG. 2 is a perspective view of a preferred infant sleep aid, revealing an internal housing.
Figure 3:
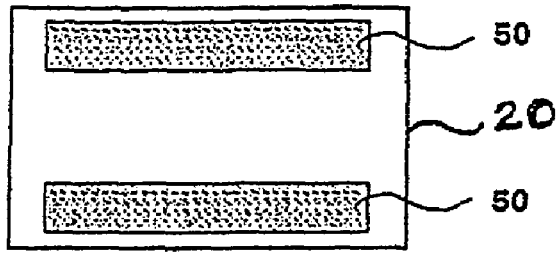
FIG. 3 is a bottom view of a sleep aid arm.

A left arm 20 and a right arm 30 are attached to a respective left side and right side of the mat. The arms are formed from foam pieces that are large enough to make the child feel secure in the crib, and form barriers to restrict the lateral movement of the infant. The arms are secured to the mat via hook and loop fasteners 50, 52 or other means, as best seen in FIGS. 2 and 3. Preferably, the placement of the arms is adjustable, enabling the user to move them nearer or farther from one another, or toward either the head or tail end of the mat, to define a space that is tailored to a particular infant. The adjustability can be accomplished via complementary wide strips of hook and loop material on the mat and one side of the arms.

As shown in FIG. 1A, the two foam arms are covered with fabric and include an external insignia 60 or other stitched or printed designs so that they resemble bear paws or other character arms, as appropriate.

Figure 4:
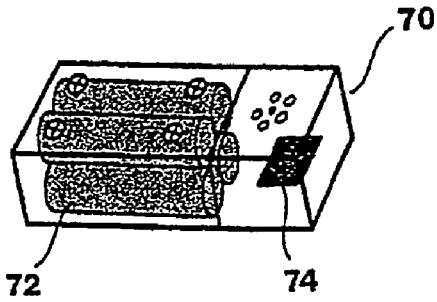
FIG. 4 is a perspective view of a preferred internal housing.

Inside one of the arms is an infant soothing device, preferably in the form of a sound and vibration module, as best seen in the cut-away view of FIG. 2. In the preferred form, shown in FIG. 4, the module is housed within a plastic box 70 having a battery chamber on one side 72 and the sound and vibration devices on the other side 74. The battery chamber includes a lid that is secured with a plurality of screws. The sound and vibration devices are preferably permanently enclosed within the plastic housing. Though the sound and vibration devices are provided within a single box, they may alternatively be provided separately. Likewise, one such device could be included within each arm, for example a sound device within a first arm and a vibration source within a second arm.

Vibration and sound devices of the type enclosed within the housing are described, for example, in U.S. Pat. No. 6,238,623, which is hereby incorporated by reference. An additional device is disclosed in U.S. Pat. No. 5,660,597, which is also incorporated by reference. A battery operated device such as that of the '597 patent, for example, may be readily incorporated into the arms of the device of the present invention.

Figure 5:
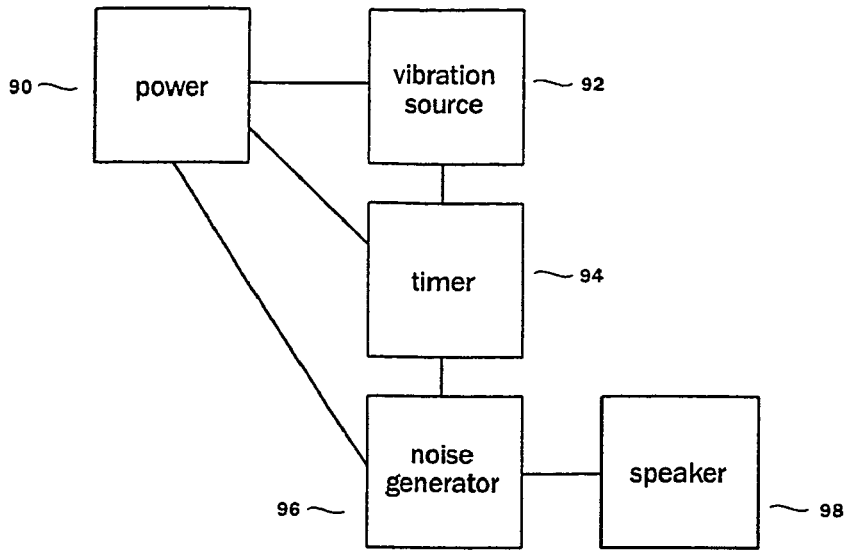
FIG. 5 is a block diagram of a preferred noise and sound generator system.

FIG. 5 illustrates a block diagram of a preferred sound system, as contained within the housing. A power source 90 is provided, preferably in the form of one or more batteries. The power source 90 is operatively connected to a vibration source 92, a timer 94, and a noise generator 96. The vibration source may comprise, for example, a system such as those described above, but preferably maintained within the housing. The noise generator may be, for example, a digital recording of a white noise source played back in an endless loop, or any other form of white noise generator. The timer 94 enables either or both of the vibration source or white noise generator to be operated either indefinitely or for preset times. For example, by depressing only a button 80 associated with the vibration source 92, the vibration begins and operates until the button is toggled off. Another button 80 associated with the noise generator operates in the same fashion. A third button triggers the timer 94 to operate either or both of the noise or vibration sources for a discrete period of time, after which they will shut off. The timer may alternatively be of the type that allows a variety of times to be used. For example, by depressing it one time it will enable the noise or vibration to continue for ten minutes. Pressing it again adds another ten minutes, so that they operate for twenty minutes. A speaker 98 is operatively connected to the noise generator as an output for the white noise.

Both the sound and vibration options will be powered by an on off switch located on the bottom right corner of the paw. A plurality of buttons 80 are accessible though the outer fabric covering of the arm, as shown in FIG. 1A. Depressing the appropriate switches will turn on or off the sound and vibration. In a simple form, simple toggle switches turn either of them on and off. In more complicated forms, as discussed below, a timer and other features are incorporated.

The operation of the noise generator, timer, and vibration source is, in a preferred form, controlled by a microprocessor having an associated memory that contains programming instructions. Depressing the various external buttons is interpreted by the microprocessor in the appropriate fashion to cause the vibration source or noise generator to produce the desired sound or vibration, and for the desired time. The memory also preferably includes multiple stored sounds, including a rhythmic heart beat and one or more musical songs or lullabies. The user can then press one or more buttons to selectively cause the appropriate sound to be played over the speaker.

Although the dimensions may be varied widely to accommodate infants of different sizes, the preferred mat is approximately thirty inches in length and fifteen inches wide. The head portion of the mat includes an internal section of foam in it for the child's head to rest on. For example, the mat comprises an upper swatch and lower swatch of fabric with a section of foam sandwiched between them. The foam piece is one inch thick and six inches wide by nine inches in length. The fabric covering the foam piece is made to look like a bears head. The optional pillow is a similar thickness. The arm or paw is about seven inches wide and five inches tall. As shown in FIG. 1A, the arms preferably include an internal size and an external side, with the internal side of each arm having a concave shape to better cradle the infant.

In use, the baby would be placed on the mat with its head on the pillow or character head. The body of the infant would be cradled between the two removable arms which are releasably attached to the mat. If desired, the vibration and white noise options may be switched on for a desired length of time, helping to soothe the baby to sleep.

While the preferred embodiment of the invention has been illustrated and described, as noted above, many changes can be made without departing from the spirit and scope of the invention. Accordingly, the scope of the invention is not limited by the disclosure of the preferred embodiment.

The invention claimed is:

1. An infant aid, comprising:

a mat having a first end, a second end, a first side, and a second side, a character face being positioned adjacent the first end of the mat;

a first barrier attached to the first side of the mat, the first barrier having a first internal cavity;

a second barrier attached to the second side of the mat; and a first infant soothing device attached to the first barrier and received within the first internal cavity; and a second soothing device attached to the second barrier;

wherein the first barrier includes first outer surface markings representative of an arm or hand related to the character and the second barrier includes second outer surface markings representative of an arm or hand related to the character.

2. The aid of claim 1, wherein the first soothing device comprises a white noise generator.

3. The aid of claim 1, wherein the first soothing device comprises a vibration generator.

4. The aid of claim 1, wherein the first soothing device comprises a music source.

5. The aid of claim 4, wherein the music source further comprises a speaker and a storage medium containing stored music.

6. The aid of claim 1, wherein the first soothing device comprises a heartbeat simulator.

7. The aid of claim 1, wherein the first soothing device comprises a white noise generator, and the second soothing device comprises a vibration generator.

8. The aid of claim 1, wherein the first barrier is formed at least partially from a flexible material and further wherein the first barrier includes a first longitudinal side and a second longitudinal side, the first longitudinal side having a concave shape.

9. The aid of claim 1, further comprising a pillow attached to the mat.

10. The aid of claim 1, further comprising a timer in communication with the first soothing device, the timer being configured to enable operation of the first soothing device for a period of time.

11. The aid of claim 1, wherein the first barrier and second barrier are each removably attached to the mat.

12. An infant aid, comprising:

a mat having a first end, a second end, a first side, and a second side;

a first barrier attached to the first side of the mat, the first barrier having a first internal cavity;

a second barrier attached to the second side of the mat; and a first infant soothing device attached to the first barrier and received within the first internal cavity; and a pillow attached to the mat.

13. The aid of claim 12, wherein the pillow further comprises first outer surface markings representative of a character face.

14. The aid of claim 13, wherein the first barrier further comprises second outer surface markings representative of an arm or hand related to the character and the second barrier further comprises third outer surface markings representative of an arm or hand related to the character.

15. The aid of claim 14, wherein the character is a bear.

16. The aid of claim 14, wherein the character is a cartoon character.

* * * * *